US006675924B2

(12) United States Patent
Takahashi et al.

(10) Patent No.: US 6,675,924 B2
(45) Date of Patent: Jan. 13, 2004

(54) COOLING APPARATUS FOR VEHICLE

(75) Inventors: Shinji Takahashi, Saitama (JP); Yuji Maki, Saitama (JP); Yasuhiro Matsumoto, Saitama (JP); Naoki Nozaki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 204 days.

(21) Appl. No.: 09/821,071

(22) Filed: Mar. 30, 2001

(65) Prior Publication Data

US 2001/0029909 A1 Oct. 18, 2001

(30) Foreign Application Priority Data

Mar. 30, 2000 (JP) ..... 2000-095164

(51) Int. Cl.[7] ..... B62K 11/00; B60K 11/04

(52) U.S. Cl. ..... 180/229; 180/68.1; 180/68.6

(58) Field of Search ..... 180/205, 220, 180/229, 223, 222, 68.6, 68.1; 280/210, 211, 215

(56) References Cited

U.S. PATENT DOCUMENTS 4,016,945 A * 4/1977 Shibata ..... 180/229
4,171,729 A * 10/1979 Shibata ..... 180/229
4,618,020 A * 10/1986 Noda et al. ..... 180/229
4,673,032 A * 6/1987 Hara et al. ..... 165/44
4,917,203 A * 4/1990 Sacco et al. ..... 180/68.6
5,046,550 A * 9/1991 Boll et al. ..... 165/41
5,176,111 A * 1/1993 Nakamura et al. ..... 123/41.01
5,199,521 A * 4/1993 Samejima et al. ..... 180/68.1
5,215,157 A * 6/1993 Teich ..... 180/69.24
5,490,574 A * 2/1996 Ishiizumi et al. ..... 180/68.1
5,715,778 A * 2/1998 Hasumi et al. ..... 123/41.51
5,984,035 A * 11/1999 Katoh et al. ..... 180/68.1
6,092,616 A * 7/2000 Burris et al. ..... 180/68.1

FOREIGN PATENT DOCUMENTS

JP U62146693 9/1987

* cited by examiner

*Primary Examiner*—Paul N. Dickson
*Assistant Examiner*—Laura B. Rosenberg
(74) *Attorney, Agent, or Firm*—Birch, Stewart, Kolasch & Birch, LLP

(57) ABSTRACT

To provide a cooling apparatus for a vehicle enabling protection of a cooling device by effectively utilizing a vehicle frame. The cooling apparatus, which is attached to a vehicle including a vehicle frame and a steering member provided at a front upper portion of the vehicle frame, has a heat exchanger, which performs thermal exchange with the outside air. The heat exchanger is provided within an area formed with a vertical plane passing through a front end of the vehicle frame and a horizontal plane passing through an upper end of the steering member.

13 Claims, 3 Drawing Sheets

COOLING APPARATUS FOR VEHICLE

BACKGROUND OF THE INVENTION

1. Field of the Invention

The present invention relates to a cooling apparatus for a vehicle. More particularly, the present invention relates to a cooling apparatus preferably applicable to a water-cooled saddle-riding type vehicle.

2. Description of Background Art

Conventionally, a vehicle, e.g., a water-cooled saddle-riding type vehicle, includes a radiator and an oil cooler. The radiator is a cooling device for cooling coolant to cool an engine mounted on a vehicle frame. Furthermore, the oil cooler is a cooling device for cooling lubricating oil for lubrication of the engine.

As disclosed in Japanese Published Unexamined Utility-Model Application No. Sho 62-146693, for example, a radiator, facing forward, is attached to a front position of the vehicle frame.

Since the cooling device in the above document is exposed on the front position of the vehicle frame, if an obstacle or the like approaches a front part of the vehicle body, the cooling device comes into direct contact with the obstacle.

To solve this problem, in the background art, a protective member projecting far forward of the cooling device is provided on the front part of the vehicle frame, to protect the cooling device since the protective member receives the obstacle or the like instead of the cooling device.

However, in this countermeasure of the background art, the vehicle weight is increased due to the addition of the protective member.

SUMMARY OF THE INVENTION

The present invention has been made in view of the above problems of the background art, and has as its object to provide a cooling apparatus for a vehicle, which protects a cooling device that does not increase the weight of the vehicle as in the background art.

In the cooling apparatus for a vehicle according to a first aspect of the present invention, to attain the above-mentioned object, a cooling apparatus for a vehicle is mounted on a vehicle having a vehicle frame and a steering member provided in a front upper position of the vehicle frame, wherein the apparatus has a heat exchanger that performs heat exchange using outside air, and wherein the heat exchanger is provided within an area formed with a vertical plane passing through a front end of the vehicle frame and a horizontal plane passing through an upper end of the steering member.

In the cooling apparatus for a vehicle according to a third aspect of the present invention, the heat exchanger according to the first or second aspects of the present invention includes a radiator that cools coolant and an oil cooler that cools lubricating oil. Furthermore, the oil cooler is attached on a front surface of the radiator.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Hereinbelow, an embodiment of the present invention will be described with reference to the accompanying drawings.

Figure 1:
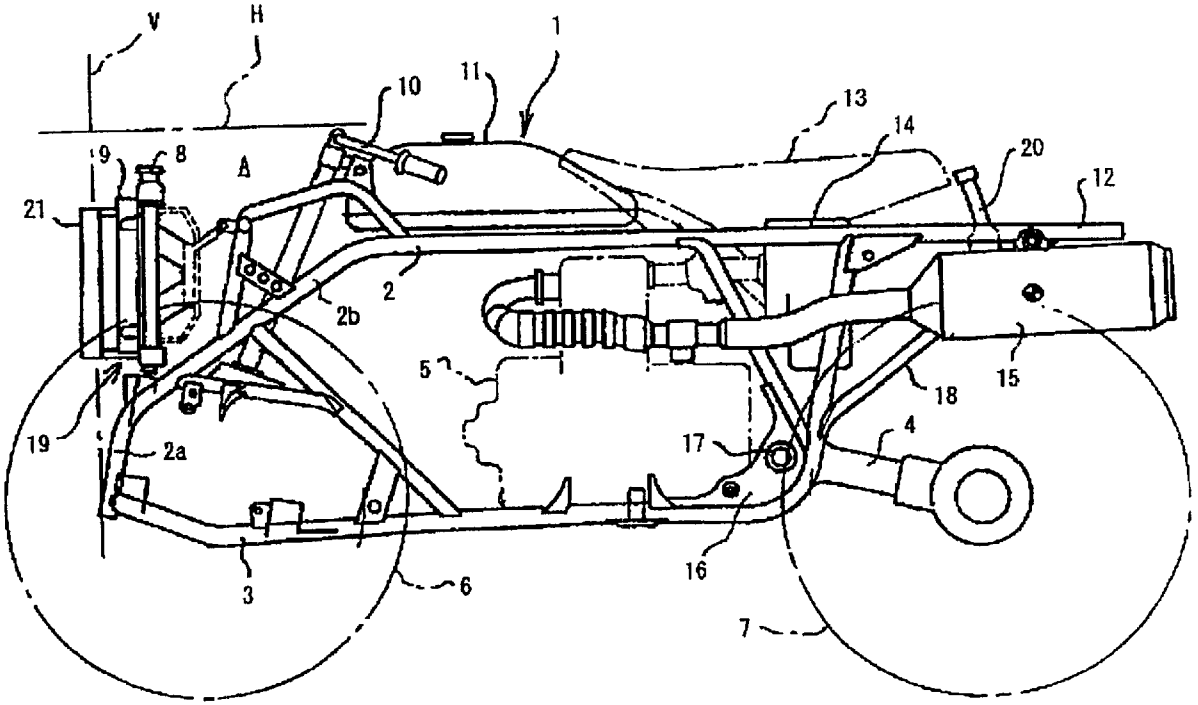
FIG. 1 is a side view illustrating a saddle-riding type vehicle to which the embodiment of the present invention is applied.

In FIG. 1, reference numeral 1 denotes a water-cooled saddle-riding type vehicle (hereinbelow referred to as a "vehicle") to which the present embodiment is applied. The vehicle 1 has a main frame 2 as a pair of left and right parts constructing an upper part of the vehicle body, an under frame 3 as a pair of left and right parts, provided below and along the main frame 2, and connected to the main frame 2 in a front position, a rear fork 4 upward/downward swingably attached in a rear position of the under frame 3, an engine 5 provided in a space formed with the main frame 2 and the under frame 3 and fixed to the under frame 3, and a front wheel 6 as a pair of left and right parts upward/downward movably attached to front left and right positions of the main frame 2 and the under frame 3, and a rear wheel 7 as a pair of parts attached to left and right positions of the rear fork 4.

Furthermore, a radiator 8, as a heat exchanger for cooling coolant circulated to the engine 5, and an oil cooler 9, as a heat exchanger for cooling lubricating oil circulated to the engine 5, are provided in front positions of the main frame 2. The radiator 8 and the oil cooler 9 together form a cooling device 19. Furthermore, a steering handle 10 for steering the front wheel 6 is provided in a front position of the main frame 2 and rearward of the radiator 8 and the oil cooler 9. Furthermore, a fuel tank 11 is provided rearward of the steering handle 10.

Furthermore, a seat 13 supported by a seat rail 12 extending in the rear of the main frame 2 is provided rearward of the fuel tank 11, and an air cleaner 14 for purifying combustion air supplied to the engine 5 is provided under the seat 13.

Furthermore, a silencer or muffler 15 for discharging burned gas to the outside and for suppressing exhaust noise is connected to the engine 5. The silencer or muffler 15 is provided between the seat rail 12 and the rear wheel 7, and is supported by the seat rail 12.

In addition, the rear fork 4 is swingably supported by a bearing 17 attached to a pivot plate 16 provided at a rear position of the under frame 3.

A seat rail stay 18 connecting the seat rail 12 to the rear part of the under frame 3 is attached below the seat rail 12. The seat rail stay 18 extends diagonally, downward and forward from the seat rail 12. Furthermore, a reserve tank 20 for supplying coolant to the radiator 8 is attached around a connection portion between the seat rail stay 18 and the seat rail 12.

A more detailed description will now be provided to further explain the embodiment of the present invention. As illustrated in FIG. 1, the main frame 2 has a front end portion comprising a vertical member 2*a* along an approximately vertical direction and a tilt member 2*b* extending diagonally, upward and rearward from an upper end of the vertical member 2*a*. The steering handle 10 is provided such that it projects upward from a position adjacent an upper end of the tilt member 2*b*. Furthermore, the radiator 8 and the oil cooler 9 are attached to the tilt member 2*b* of the main frame 2.

The radiator 8 and the oil cooler 9 are provided within an area A formed with the tilt member 2*b* of the main frame 2, a vertical plane V passing through the front end of the main frame 2, and a horizontal plane H passing through an upper end of the steering handle 10.

Furthermore, a front grill 21 is attached to the radiator 8 such that the grill covers a front portion of the radiator 8 and the oil cooler 9.

In the present embodiment, the oil cooler 9 is attached to the radiator 8 such that the oil cooler is located at the front surface of the radiator 8.

Figure 2:
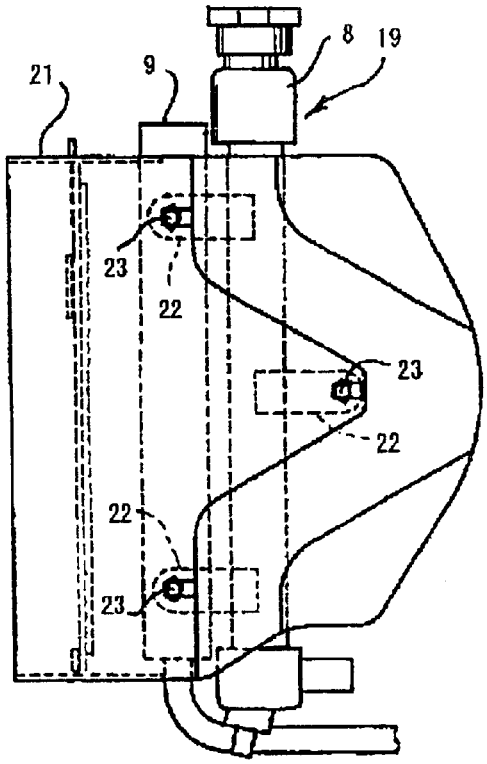
FIG. 2 is an expanded side view of the embodiment of the cooling apparatus of the present invention.
Figure 3:
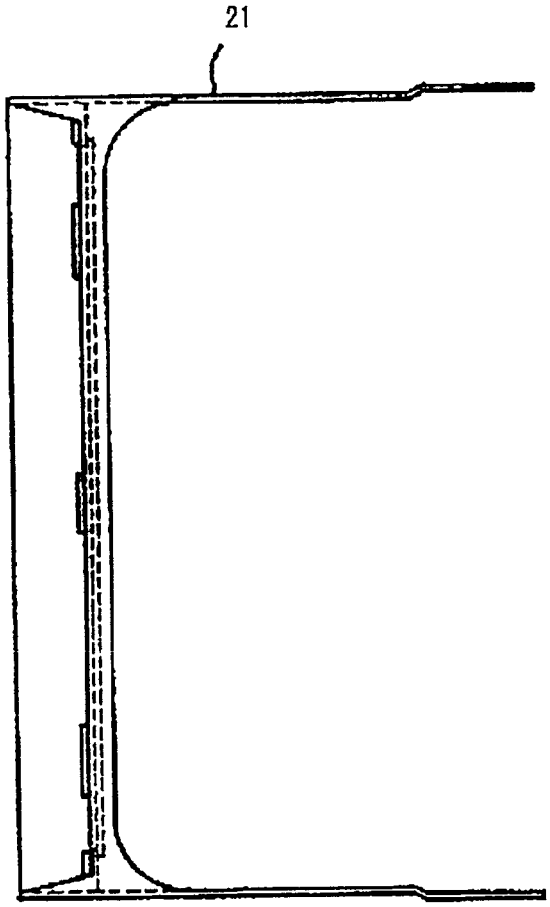
FIG. 3 is a plan view of the front grill attached to the cooling apparatus according to the embodiment of the present invention.

Furthermore, as shown in FIG. 3, the front grill 21 is formed to have an approximately C-shaped cross section. In addition, as shown in FIG. 2, the front grill 21 is fixed by bolts 23 at both sides thereof to plural stays 22 provided on side surfaces of the radiator 8.

The front grill 21 forms openings on and under the radiator 8 in a state where it is attached to the radiator 8.

In the cooling apparatus for a vehicle according to the present embodiment constructed as above, since the radiator 8 and the oil cooler 9 are provided within the area A formed with the tilt member 2*b* of the main frame 2, the vertical plane V passing through the front end of the main frame 2, and the horizontal plane H passing through the upper end of the steering handle 10, the front end of the main frame 2 first comes into contact with an obstacle which approaches from a front direction, and the upper end of the steering handle 10 first comes into contact with an obstacle which approaches from an upper direction.

As a result, the front end of the main frame 2 and the upper end of the steering handle 10 function as protective members for the radiator 8 and the oil cooler 9. Accordingly, protection of the radiator 8 and the oil cooler 9 is assured.

Furthermore, since the main frame 2 is an existing portion of the vehicle frame and the steering handle 10 are used as the protective members for the radiator 8 and the oil cooler 9, the aforementioned protection can be attained without increasing the vehicle constituent parts and therefore the weight of the vehicle.

Furthermore, as shown in the present embodiment, since the front end portion of the main frame 2 comprises the vertical member 2*a* along the approximately vertical direction and the tilt member 2*b* extending diagonally, upward and rearward from the upper end of the vertical member 2*a*, the above-described area A can be easily ensured.

In addition, since the oil cooler 9 is attached to the front surface of the radiator 8, a fixing member for the oil cooler 9 can be omitted and the number of the constituent parts can therefore be reduced.

Furthermore, foreign material entering into a front part of the oil cooler 9 or the radiator 8 can be quickly discharged to the outside from a lower position by fixing the front grill 21, with its upper and lower portions opened, to the radiator 8.

It should be noted that the shapes and dimensions of the respective constituent members shown in the above embodiment are given as an example only, and various changes can be made based on designing requirements and the like.

As described above, according to the cooling apparatus for a vehicle of the present invention, since a heat exchanger forming a cooling device of the vehicle is provided within an area formed within a vertical plane passing through a front end of a main frame and a horizontal plane passing through an upper end of a steering handle, the front end of the main frame first comes into contact with an obstacle which approaches from a front direction. Furthermore, the upper end of the steering handle first comes into contact with an obstacle, which approaches from an upper direction. Since the existing vehicle body constituent members are utilized as protective members of the heat exchanger, the protection of the heat exchanger can be attained without increasing the vehicle constituent members and therefore the weight of the vehicle.

In addition, since the heat exchanger comprises a radiator and an oil cooler, and the oil cooler is attached to the front surface of the radiator, a fixing member for the oil cooler can be omitted and the number of constituent parts can be reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cooling apparatus mounted on a vehicle, said vehicle having a vehicle main frame and a steering member provided in a front upper position of said vehicle main frame, said cooling apparatus comprising:

a heat exchanger that performs heat exchange using outside air, said heat exchanger being provided within an area formed by a vertical plane passing through a front end of the vehicle main frame and a horizontal plane passing through an upper end of the steering member;

said heat exchanger including a radiator for cooling coolant and an oil cooler for cooling lubricating oil, said oil cooler being attached on a front surface of said radiator; and said vehicle includes a front grill having two backwardly extending arms directly attached to opposite sides of said radiator for covering a front portion of said oil cooler and said radiator, said front grill having an approximately C-shaped cross section when viewed from above.

2. The cooling apparatus according to claim 1, wherein a front end portion of said vehicle main frame comprises:

a tilt member extending diagonally, upward and rearward from the front end of said vehicle main frame;

said steering member is provided projecting upward from a position adjacent an upper end of said tilt portion; and said heat exchanger is attached to said tilt member of said vehicle main frame.

3. The cooling apparatus according to claim 2, wherein said area in which said heat exchanger is provided is also bounded by said tilt member.

4. The cooling apparatus according to claim 1, wherein a front end portion of said vehicle main frame comprises:

a tilt member extending diagonally, upward and rearward from the front end of said vehicle main frame; and said area in which said heat exchanger is provided is also bounded by said tilt member.

5. The cooling apparatus according to claim 1, wherein said heat exchanger is located below said horizontal plane and rearward of said vertical plane.

6. A vehicle, comprising:

a vehicle main frame;

a steering member provided in a front upper position of said vehicle main frame; and a cooling apparatus mounted on said vehicle main frame, said cooling apparatus comprising:

a heat exchanger that performs heat exchange using outside air, said heat exchanger being provided within an area formed by a vertical plane passing through a front end of the vehicle main frame and a horizontal plane passing through an upper end of the steering member;

said heat exchanger including a radiator for cooling coolant and an oil cooler for cooling lubricating oil, said oil cooler being attached on a front surface of said radiator; and said vehicle including a front grill having two backwardly extending arms directly attached to opposite sides of said radiator for covering a front portion of said oil cooler and said radiator, said front grill having an approximately C-shaped cross section when viewed from above.

7. The vehicle according to claim 6, wherein a front end portion of said vehicle main frame comprises:

a tilt member extending diagonally, upward and rearward from the front end of said vehicle main frame;

said steering member is provided projecting upward from a position adjacent an upper end of said tilt portion; and said heat exchanger is attached to said tilt member of said vehicle main frame.

8. The vehicle according to claim 7, wherein said area in which said heat exchanger is provided is also bounded by said tilt member.

9. The vehicle according to claim 6, wherein a front end portion of said vehicle main frame comprises:

a tilt member extending diagonally, upward and rearward from the front end of the vehicle main frame; and said area in which said heat exchanger is provided is also bounded by said tilt member.

10. The vehicle according to claim 6, wherein said heat exchanger is located below said horizontal plane and rearward of said vertical plane.

11. A cooling apparatus for a vehicle, said vehicle having a vehicle main frame and a steering member provided in a front upper position of said vehicle main frame, said cooling apparatus comprising:

a heat exchanger that performs heat exchange using outside air, said heat exchanger being mountable within an area formed by a vertical plane passing through a front end of the vehicle main frame and a horizontal plane passing through an upper end of the steering member;

said heat exchanger including a radiator for cooling coolant and an oil cooler for cooling lubricating oil, said oil cooler being attached on a front surface of said radiator;

said vehicle including a front grill having two backwardly extending arms directly attached to opposite sides of said radiator for covering a front portion of said oil cooler and said radiator, said front grill having an approximately C-shaped cross section when viewed from above.

12. The cooling apparatus according to claim 11, wherein a front end portion of the vehicle main frame comprises:

a tilt member extending diagonally, upward and rearward from the front end of the vehicle main frame;

the steering member is provided projecting upward from a position adjacent an upper end of the tilt portion; and said heat exchanger is attachable to said tilt member of the vehicle main frame.

13. The cooling apparatus according to claim 11, wherein said heat exchanger is located below said horizontal plane and rearward of said vertical plane.

* * * * *